United States Patent [19]

Marshall et al.

[11] 4,240,212

[45] Dec. 23, 1980

[54] THERMAL SIGNATURE TARGETS

[75] Inventors: Albert H. Marshall, Maitland; Bon F. Shaw; George A. Siragusa, both of Winter Park; Herbert C. Towle, Maitland, all of Fla.

[73] Assignee: The United States of America as represented by the Secretary of the Navy, Washington, D.C.

[21] Appl. No.: 50,578

[22] Filed: Jun. 21, 1979

[51] Int. Cl.[3] ..... F41G 3/26; H05B 3/02; H05B 3/16

[52] U.S. Cl. ..... 434/11; 219/354; 219/543; 250/495; 273/348

[58] Field of Search ..... 35/25; 250/495, 504; 219/354, 543, 345; 273/348, 360, 371; 340/515, 565, 567

[56] References Cited

U.S. PATENT DOCUMENTS

| | | | |
|---|---|---|---|
| 3,227,879 | 1/1966 | Blau et al. | 250/495 X |
| 3,283,148 | 11/1966 | Schwarz et al. | 250/330 X |
| 3,333,103 | 7/1967 | Barnes | 219/345 X |
| 3,367,795 | 2/1968 | Stutzman | 219/543 X |
| 3,749,886 | 7/1973 | Michaelsen | 219/543 X |
| 4,035,613 | 7/1977 | Sagawa et al. | 219/543 X |
| 4,058,704 | 11/1977 | Shimizu | 219/543 X |
| 4,071,737 | 1/1978 | Marshall et al. | 219/543 X |

*Primary Examiner*—Joseph Scovronek

*Attorney, Agent, or Firm*—Richard S. Sciascia; Robert W. Adams

[57] ABSTRACT

A technique for simulating the thermal appearance of objects. Electrical energy is applied to conductive material that is attached to a mounting surface shaped in the form of the selected object. The conductive material is placed to simulate the radiation pattern that the object has been shown to demonstrate.

16 Claims, 2 Drawing Figures

THERMAL SIGNATURE TARGETS

BACKGROUND OF THE INVENTION

Surveillance and military style weaponry expanded into the field of infrared detection and homing some time ago. Since then numerous developments have occurred that have progressed the state of the art to a level of complexity and effectiveness which substantially assures reliable hardware. The effectiveness of the hardware for its intended purpose is now to a large extent determined by the operator. Accordingly, thorough training is important.

For training, the more complete the simulation is of the actual operating environment, the more realistic and thorough the training procedure can be. If field conditions will be encountered in using the hardware, field-like conditions are desirable for training. If infrared surveillance is an element of operation, infrared sources that simulate the infrared signatures of the objects to be anticipated are required.

Practices in the past have employed infrared sources that range from the object itself to pyrotechnic devices. Up to now there has been no way to both economically and accurately imitate the thermal signature gradients of the object source. The present invention fills the need. Further, the present invention provides a technique that can be economically used to create excellent targets which are rugged and transportable.

Within the field of the invention are elaborate systems employing cooperating elements in both the object and the surveillance station. Most often one of the elements is a modification within a weapon located at the station. At times the object is presented as only an image projected on a screen. Thus, the environment is strictly controlled, the weapon is not meant to be actually fired, and realism suffers. Likewise, when the target is actually deployed, its value typically precludes permitting it to be destroyed, so simulation at the weapon end must be attempted. In these cases, lasers with cooperating hit or miss indicators are used.

When trainees must experience actually firing the weapon, worthless carcasses of trucks, and the like, have been heated and used. But the supply of such targets is limited. And, realism is seldom complete. For example, if one is attempting to simulate the infrared signature of an operating truck, a truck bed with engine and tires removed does not appear as a duplicate. In addition, attempts with more maneuverable structures, such as trash receptacles and plywood silhouettes, have been equally unsuccessful, even when heated by simple and ingenious means such as charcoal or hot water bottles. In the case of personnel, there has been no previous technique for imitating the thermal signature of a man.

The present invention dramatically improves the state of the art by providing an easily implemented, low cost, portable imitator of infrared sources. The invention permits the construction of rugged and expendable targets that accurately simulate the infrared signature of any selected object. In accordance with the invention, targets can be constructed for military training by the user activity at the training facility, targets that are remarkably realistic and simple of design and construction.

SUMMARY OF THE INVENTION

The present invention is the employment of electrically resistive material strategically placed on a form and energized to create an infrared signature that realistically simulates some selected object.

The invention was originated by work designed to improve the targets employed by the military services for training on infrared equipment. Some of the weapons used by the Services, particularly the U.S. Army, employ thermal sights that provide the observer with an all-weather capability of detecting hostile equipment. The observer sees a form, but a form that is not necessarily the same as the shape of the object or equipment. Instead it is a pattern of the thermal gradients. The present invention is the means to create the same pattern of gradients by imitation.

The invention is not limited to targets, or to military applications. Any field that has a need to simulate thermal signatures can benefit. Training programs for employees of manufacturers that require surveillance of the thermal appearance of a process or equipment can use the invention to improve recognition of deficiencies and hazards. Other fields that employ surveillance and detection by infrared means are benefitted by proper training and are, therefore, candidates for the advantages afforded by the present invention.

The electrical material that is heated by the energizing source to form the desired thermal pattern may be applied to the form or made a part of it during construction as part of the structural assembly itself. The energizer may be a battery or other source of electrical energy. The material may be paint, tape, or any other electrically conductive material in any combination to create the thermal pattern desired in its varying intensity. The form may be plywood or other material that will support the electrically conductive elements. The form may also be an assembly of appropriate conductive elements and other structural members, as noted above, and disassembleable, foldable, otherwise portable, or fixed, as desired.

The point is that the invention may take any form or shape and still be practiced. A pattern of electrically conductive members is arranged to simulate the thermal signature of a selected object or grouping and energized. The embodiment originally implementing the invention was a simulated target of plywood supporting carbon impregnated paper heated by current from a battery. The plywood was formed into the silhouette of a tank and rendered moveable to imitate a moving target. A bubble plastic layer was applied over the paper to reduce convective heat loss.

DESCRIPTION OF A PREFERRED EMBODIMENT

Figure 1:
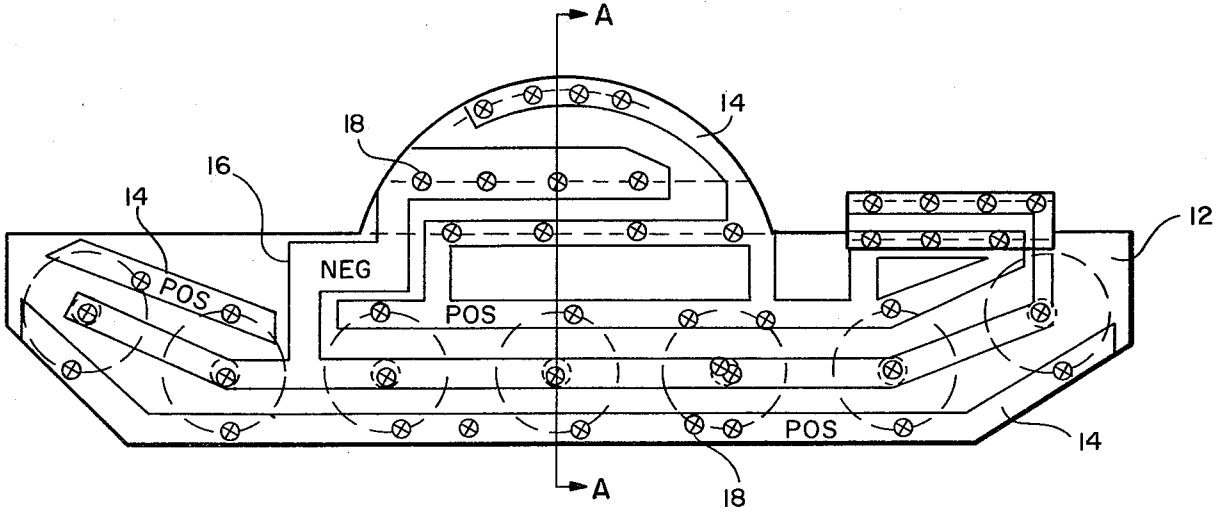
FIG. 1 is a rear side view of a vehicle target made in accordance with the invention, showing a layout of electrically conductive paths and the contacts coupling the rear side to the emitting surfaces on the front.

An example of the present invention is shown in FIG. 1. The rear view of form 12 shows conductive strips that are laid out in an arrangement that corresponds to the pattern selected for the contact points on the front surface of the form. Strips 14 and 16 are positive and negative busses, respectively, that connect leads 18. Leads 18 are positioned from the front side of form 12 in an arrangement that will provide the desired infrared signature when an electrical source is coupled to strips 14 and 16.

The front side of form 12 has resistive material that is electrically conductive and connected to strips 14 and 16 by leads 18. The electrical path for heating the resistive material is from the source of electrical energy, along positive strip 14 to the resistive material on the front side of the form via leads 18, through the resistive material to one of the leads 18 that is connected to negative strip 16, and from negative strip 16 back to the electrical source.

Figure 2:
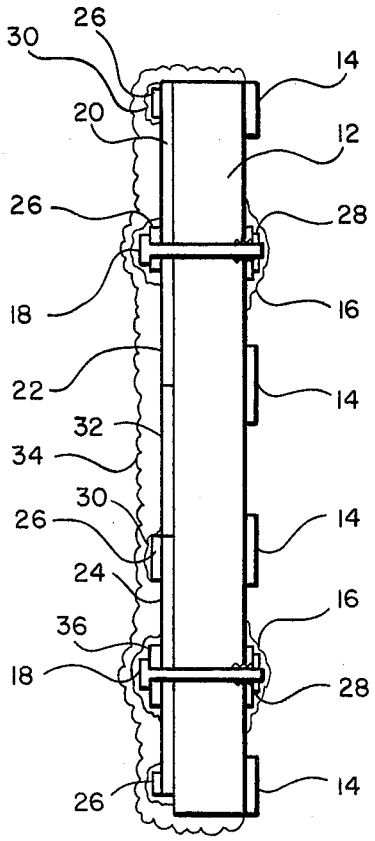
FIG. 2 is an unscaled, cross-sectional view along line A—A of FIG. 1, showing a preferred embodiment of the invention.

Placement of the resistive material on the front side of form 12 is shown in the cross-sectional view A—A of FIG. 2. The size of some members shown in FIG. 2 is greatly exaggerated to facilitate discussion. Resistive material 20–24 may be a carbon filled product and is coupled to leads 18 by conductive members 26. Members 26 provide good contact with material 20–24 between adjacent leads of like polarity. This promotes uniform current flow from positive to negative in a sheet-like fashion over the entire surface between members of opposite polarity rather than from point to point. Leads 18 are shown in this example as nut, washer and bolt 28.

The distance between members 26 of opposite polarity is determinative of thermal intensity, along with the parameters of the resistive material used. Distances are therefore chosen to achieve the thermal pattern desired. Hotter spots appear where less resistive material separates oppositely charged members 26.

An example of resistive material 20–24 is Temsheet, a paper product from Armstrong Cork Corporation that, like similar products, is described in terms of resistance per square. The resistance of Temsheet is nominally 60 ohms per square. The only parameters of importance for a square are the thickness and resistivity of the material. The resistance of a rectangular layer is calculated by multiplying the ohms per square by the number of squares in series and dividing by the number in parallel. A paint product, Eccocoat, is another example of a resistive material that can be used in place of, or in conjunction with, other resistive materials, as shown in FIG. 2 by layer 30. Portions of layer 30 would probably not be the resistive coating where a variety of thermal intensities are desired. In those portions, such as at layer 32, a conventional flat black paint would be sufficient in most environments to provide a lower intensity level that is still higher than background levels.

The total amount of radiation emitted by a body may be calculated from the Stefan-Boltzman equation which shows that electromagnetic radiation is a strong, 4th power function of temperature. Emissivity of the body is also a factor and, if the surface is black, emissivity will be relatively high. Thermal sights view in the far infrared range of emitted electromagnetic radiation. Most of the electromagnetic radiation produced by objects within 50° to 100° of room temperature is in the 8 to 14 micron, or far infrared, range. Accordingly, an increase in the temperature of a body common to our environment substantially increases the radiation of energy in the far infrared range.

To effect an increase in electromagnetic radiation from a body, energy is needed not only to increase its temperature, but supply the losses as well. Where infrared sensing is concerned, losses are caused by the body's thermal inertia, convection, and by radiation that is emitted from surfaces of the target not viewed by the thermal sight. Convection losses are losses to the air which provides essentially no useful radiation. They increase with air movement unless the body is insulated, such as is shown in FIG. 2 by thermal blanket 34. Power sufficient to provide all the losses and a level of useful radiation high enough to permit detection, should be designed into the system. Once the object has been heated to the equilibrium temperature its heat capacity, or thermal inertia, is no longer a factor to be considered for power-in requirements, since capacity, or inertia, is a function of temperature change. Note that the input power is the summation of all sources that tend to heat the object, primarily the electrical source added and incoming light, as when exposed to the sun or daylight. Inasmuch as a properly constructed object will retain heat and therefore be significantly more radiant than the background, even at night and without an electrical input, an especially sensitive sensor could be used for training during those periods.

Although design equations can be derived for any intended application by starting with power-in = power-out, making assumptions, and using emissivity and thermal conductivity values identified by such as W. H. McAdams, and J. H. Duffie and W. A. Beckman, in "Heat Transfer", McGraw-Hill, 1954, and "Solar Energy Thermal Processes", John Wiley and Sons, 1974, respectively, an effective design involves an element of art developed through trial and error. A scale or Reynold's Number effect would be appropriate, if necessary. The end objective is to imitate a real world object. Trial and error using materials of the general type discussed herein will achieve a design suitable for most purposes.

An example of one design that has been developed employs ⅜" plywood for form 12 of FIGS. 1 and 2. The plywood is shaped to present a profile of a tank, either frontal or side views. Two by four members are used as needed for support. Placed on the front face of the form are two side-by-side Temsheet T-62 sheets covering the turret. The sheets do not overlap and the seam is covered by 0.002" thick copper stripping 26 tacked in place. Simulated wheels of Temsheet are mounted on the plywood by means of copper disc 36 at the hub and copper stripping 26 around the perimeter. The stripping may need to be folded to lay flat and conform to the circumference of the wheel. Likewise, copper stripping is folded and applied to the crown of the turret. The hub and stripping are tacked, or stapled in place. Staples are lineally aligned with the edge of the copper electrodes to insure good contact with the underlying Temsheet.

Electrical contacts are made with machine screws or bolts 18 through holes drilled in the form and electrodes. Representative placement of contacts 18 is shown in FIG. 1. Staples and nails underneath the screw heads should be removed to maximize electrical contact. Aluminum tape applied to the back of shaped plywood 12 of FIG. 1 forms positive and negative busses 14 and 16 when connected to a power source such as a battery, not shown. The tape provides a continuous conductive link across the plywood and over the two by four frame members.

Good electrical contact of the copper to the Temsheet is insured with an application of conductive paint 30, such as Eccocoat SEC, to all screw heads, washers, copper stripping, and nail heads on the front side of the form. The remainder of the exposed front surface is coated with water based, flat black paint which has, itself, high emissivity.

Finally, a bubble plastic layer is wrapped around the front surface of the form as thermal blanket 34 to reduce convective losses.

A 22 ft. by 7 ft. model of FIGS. 1 and 2 requires 36 volts of DC power for best results, and that figure should not be exceeded for the design shown. Twenty-four volts is sufficient under some environmental conditions, such as low wind speeds, to provide an adequate thermal image for the user.

Obviously many modifications and variations of the present invention are possible in light of the above teachings. It is, therefore, to be understood that within the scope of the appended claims the invention may be practiced otherwise than as specifically described.

What is claimed is:

1. Structure that simulates the thermal appearance of an object by imitating the infrared signature that the object is known to provide, comprising in combination:

a mounting member having front and rear surfaces;

material that is substantially two-dimensional and of uniform linear resistivity, and that is infrared emissive when electrically activated, applied to the front surface of said member in a predetermined pattern that includes an arrangement of conductive strips overlaying said material for distributing electrical current to said material, and that are spaced such that some portions of the material will be more emissive than other portions and the relative thermal intensities over said pattern will approximate the thermal appearance of said object when the structure is electrically activated;

electrically positive and electrically negative busses affixed to the rear surface of said member opposite said member from the conductive strips on said front surface;

contacts electrically coupling said busses on said rear surface to said conductive strips on said front surface; and a source of electrical energy coupled to said busses.

2. The structure of claim 1, wherein said material is carbon filled and applied to said member in locations corresponding to the most thermally active areas of said object.

3. The structure of claim 1, wherein said busses are electrically conductive tape positioned opposite and in alignment with said conductive strips.

4. A training device for use in association with sensors designed to permit an operator to view infrared emissions, in combination comprising:

a source of electrical energy;

a form erected to support other members of said combination; and means mounted to said support and coupled to said energy source for providing a conductive path that resistively heats and thereby emits infrared radiation in a preselected pattern that is observable by said operator, including a resistively conductive coating on one surface of said form with interdigitus conductive fingers on the opposite surface of said form and conductive contacts piercing said form coupling said fingers to said coating such that electric current is conveyed in a circuit path from said fingers through said coating by way of said contacts and back to oppositely charged fingers on said opposite surface.

5. The device of claim 4, wherein said form is a black silhouette of an object that is to be identified by said operator.

6. The device of claim 4, wherein said source of electrical energy is at least one battery.

7. The device of claim 4, wherein said means is carbon filled paint.

8. The device of claim 4, wherein said coating is carbon filled paper.

9. A target for training personnel in the use of weaponry systems that are sensitive to infrared radiation, as by infrared detectors or operator controlled sensors which permit identification of the target as a realistic simulation of a threat related object, wherein the combat weaponry system is employed and may be discharged in response to such identification, comprising:

an electrically non-conductive form shaped into the silhouette of said object;

carbon filled material strategically placed on the surface of said silhouette form that faces said personnel to create a thermal signature when electrically biased which approximates the pattern of infrared radiation emitted by said object under like environmental conditions;

conductive strips in covering relationship to said material and electrically coupled thereto;

bus members of negative electrical polarity and of positive electrical polarity fixed to said silhouette on the surface opposite said personnel facing surface and in at least partial alignment through said form with said strips;

connectors electrically coupling each of said bus members to said strips to form a plurality of electrical paths from the positive polarity bus member to the negative polarity bus member by way of one or more connectors to the positive polarity conductive strips and through said material to the negative polarity conductive strips coupled by connectors to the negative polarity bus member; and a source of electrical energy coupled to said bus members.

10. The target of claim 9, wherein said form is wooden.

11. The target of claim 9, wherein the portions of the personnel facing surface of said form that are not covered by said material, are covered by black paint.

12. The target of claim 11, wherein said material is a paper product.

13. The target of claim 9, wherein said material is black paint.

14. The target of claim 9, wherein said strips are copper and said bus members are aluminum tape.

15. The target of claim 9, further comprising means covering said personnel facing surface is a thermal blanket for reducing convective energy losses.

16. The target of claim 15, wherein said thermal blanket means is of bubble plastic sheeting.

* * * * *